US005234509A

United States Patent [19]

Tull

[11] Patent Number: 5,234,509

[45] Date of Patent: Aug. 10, 1993

[54] COLD DEFORMATION PROCESS EMPLOYING IMPROVED LUBRICATION COATING

[75] Inventor: Thomas W. Tull, Royal Oak, Mich.

[73] Assignee: Henkel Corporation, Plymouth Meeting, Pa.

[21] Appl. No.: 637,995

[22] Filed: Jan. 4, 1991

Related U.S. Application Data

[63] Continuation of Ser. No. 240,353, Aug. 8, 1988, abandoned, which is a continuation of Ser. No. 683,841, Dec. 20, 1984, abandoned.

[51] Int. Cl.[5] ..... C23C 22/83

[52] U.S. Cl. ..... 148/246; 148/262

[58] Field of Search ..... 148/246, 262; 72/42

[56] References Cited

U.S. PATENT DOCUMENTS

| | | | |
|---|---|---|---|
| 2,298,280 | 10/1942 | Clifford | 148/6.15 R |
| 2,657,156 | 10/1953 | Hyams et al. . | |
| 2,702,768 | 2/1955 | Hyams et al. . | |
| 2,743,204 | 4/1956 | Russel | 148/6.15 Z |
| 2,928,762 | 3/1960 | Hyams . | |
| 3,615,912 | 10/1971 | Dittel | 148/6.15 R |
| 3,839,099 | 10/1974 | Jones | 148/6.15 R |
| 4,003,761 | 1/1977 | Gotta et al. . | |
| 4,017,334 | 4/1977 | Matsushima et al. . | |
| 4,148,670 | 4/1979 | Kelly . | |
| 4,149,909 | 4/1979 | Hamilton | 148/6.15 R |
| 4,220,486 | 9/1980 | Matsushima et al. . | |
| 4,517,029 | 5/1985 | Sanoda | 148/6.15 Z |
| 4,983,229 | 1/1991 | Tull . | |

FOREIGN PATENT DOCUMENTS

| | | |
|---|---|---|
| 0042631 | 12/1981 | European Pat. Off. . |
| 0155547 | 9/1985 | European Pat. Off. . |
| 0315059 | 5/1989 | European Pat. Off. . |
| 0398202 | 11/1990 | European Pat. Off. . |
| 3543733 | 3/1986 | Fed. Rep. of Germany . |
| 849856 | 12/1939 | France . |
| 1172741 | 2/1959 | France . |
| 510684 | 1/1939 | United Kingdom . |
| 963540 | 7/1964 | United Kingdom . |
| 2011954 | 7/1979 | United Kingdom . |
| 2033432 | 5/1980 | United Kingdom . |
| 2137231 | 10/1984 | United Kingdom . |

*Primary Examiner*—Sam Silverberg
*Attorney, Agent, or Firm*—Harness, Dickey & Pierce

[57] ABSTRACT

In the practice of the instant invention, a lubricating phosphate coating is applied to the surface of a ferrous-base metal article by contacting the surface with an aqueous acidic phosphate coating solution which contains an amount of hydroxylamine which is effective in increasing the rate at which the phosphate coating deposits from the solution. The resulting coated article is then subjected to cold deformation.

In a preferred embodiment, the metal article is additionally contacted with a second lubricating compound after the phosphate coating is applied. In addition to phosphate, the coating solutions employed preferably contain one or more of the following ions: zinc, manganese, nitrate, nickel, ferrous, ferric, copper, fluoride, or mixtures thereof.

25 Claims, No Drawings

COLD DEFORMATION PROCESS EMPLOYING IMPROVED LUBRICATION COATING

This is a continuation of U.S. patent application Ser. No. 240,353, filed Aug. 8, 1988 now abandoned which is a continuation of U.S. Ser. No. 683,841 filed Dec. 20, 1984 now abandoned.

BACKGROUND OF THE INVENTION

Metal phosphate coating solutions are dilute solutions of phosphoric acid and other chemicals which are applied to the surface of metal; the surface of the metal reacts with the solution and forms an integral layer (on the surface of the metal) of substantially insoluble crystalline phosphate. This layer is applied primarily for protection from corrosion, or as a base for the application of a second coating (e.g., paint), or as a vehicle to retain a lubricant on the coated surface.

Metal phosphate coatings are well known as being useful in the forming of metals. The metal phosphate coating, when applied to the surface of an article about to be subjected to formation, reduces the friction created by drawing or cold forming operations; the coating reduces the great amount of friction between the metal surface and the die. The conversion of the metal surface to a phosphate coating reduces this friction primarily by increasing the ability of the metal to retain a uniform film of lubricant over the entire surface; this ability to retain a lubricant is critical—it is this second lubricant which actually prevents welding and scratching in drawing operations, and reduces metal to metal contact in cold forming operations. This reduction in friction allows shapes to be made by cold forming which would otherwise not be possible or practicable.

The present invention relates to a cold deformation process which employs phosphate coating solutions particularly suited to applying a lubricating (or lubricant-retaining) phosphate coating. The unique character of this coating stems from its application or deposition from a coating solution employing hydroxylamine.

The use of hydroxylamine in coating solutions is known in the art.

U.S. Pat. No. 2,298,280, issued Oct. 13, 1942, discloses the use of hydroxylamine in phosphate coating solutions as an accelerator to assist in depositing corrosion-resisting paint base phosphate coatings. However, the absence of nitrate, in combination with relatively low levels of zinc and phosphate, render the exemplified solutions capable of providing lubricating coatings which are only marginally effective for undemanding cold forming processes (e.g., wire and tube pulling); such solutions would be wholly unacceptable for providing lubricating phosphate coating for metal surfaces about to undergo demanding cold deformation operations (e.g., the extrusion of large parts).

U.S. Pat. No. 2,702,768, issued Feb. 22, 1955, describes the use of hydroxylamine in "noncoating phosphate" solutions, such as those which contain sodium, potassium and ammonium phosphates.

U.S. Pat. No. 2,928,762, issued Mar. 15, 1960, discloses the use of hydroxylamine phosphate as a reducing agent in an orthophosphoric acid preliminary rinse solution in a phosphate coating process.

U.S. Pat. No. 4,003,761, issued Jan. 18, 1977, discloses a process for applying a phosphate coating to a ferric surface. This process comprises spraying the surface with an aqueous acid solution having a pH of 4.3 to 6.5 and which contains an alkali metal or ammonium salt. The solution additionally contains an oxidizing or reducing agent accelerator, from 0.05 to 1.0 gram per liter of a $C_2$–$C_4$ alkylolamine, and a wetting agent.

U.S. Pat. No. 4,149,909, issued Apr. 17, 1979, discloses accelerated phosphatizing compositions containing hydroxylamine sulfate (as a source of hydroxylamine in the use solution) to provide a hydroxylamine plus chlorate/bromate accelerator combination.

U.S. Pat. No. 4,220,486, issued Sep. 2, 1980, discloses conversion coating solutions having a pH of 5.5 to 6.5 which optionally employ 0.2 to 5.0 grams per liter of pyrazole, hydroxylamine or hydrazine compounds. These compounds are added to stabilize the use solutions.

Thus, the art has recognized that hydroxylamine, or hydroxylamine salts or complexes, can be employed to assist in depositing coatings designed to serve as a paint base, or as a corrosion-inhibiting base. However, it has now been surprisingly discovered that moderate to heavy phosphate coatings applied from a phosphate coating solution which contains hydroxylamine are particularly well suited to act as lubricating (or lubricant-retaining) coatings on ferrous-base metal surfaces which are about to undergo cold deformation. It has also been surprisingly discovered that phosphate coatings particularly suited for prelubricantion of articles about to undergo cold deformation can be deposited even in the presence of ferrous, or ferrous and ferric, ions, when hydroxylamine is employed.

SUMMARY OF THE INVENTION

The present invention relates to a process for the cold deformation of metal articles. The benefits and advantages of the present invention are achieved by providing an integral phosphate coating upon the surface of the metal article from a phosphate coating solution which contains hydroxylamine.

In the practice of the instant invention, a lubricating phosphate coating is applied to the surface of a ferrous-base metal article by contacting the surface with an aqueous acidic phosphate coating solution which contains an amount of hydroxylamine which is effective in increasing the rate at which the phosphate coating deposits from the solution. The resulting coated article is then subjected to cold deformation.

In a preferred embodiment, the metal article is additionally contacted with a second lubricating compound after the phosphate coating is applied. In addition to phosphate, the coating solutions employed preferably contain one or more of the following ions: zinc, manganese, nitrate, nickel, ferrous, ferric, copper, fluoride, or mixtures thereof.

Prior to phosphatizing, the metal article may be subject to one or more conventional pretreatment steps, such as cleaning, pickling, rinsing, and the like. Following phosphatizing, the coated article can be subjected to one or more post-treatment steps such as neutralizing, rinsing, drying or the like prior to cold deformation; coating may also be followed by a second lubrication step.

The moderate to heavy coating which results is uniquely capable of providing lubricity thus increasing the efficiency of conventional cold deformation processes.

Additional benefits and advantages of the present invention will become apparent upon a reading of the Detailed Description of the Invention taken in conjunction with the specific examples provided.

DETAILED DESCRIPTION OF THE INVENTION

The cold formation processes of the present invention employ a high-quality lubricating phosphate surface coating.

The lubricating phosphate coatings employed in the processes of the present invention are deposited upon the surface of a ferrous-base metal article which is about to undergo cold deformation; they are uniquely suited for providing lubrication during such processes. The unique quality of these coatings is attributable to (1) their ability to provide lubrication alone during cold deformation processes and/or (2) their ability to retain a second lubricant or lubricating agent during such processes.

The terms "cold formation" and "cold deformation" are used interchangeably herein. By the use of these terms herein is meant any forming operations where the article (e.g., blank, slug or preform) about to undergo deformation enters the deformation process at a temperature appreciably below the recrystallization temperature, and preferably within 100° C. of room temperature; and where any subsequent rise in temperatures is primarily due to the friction and/or heat from work hardening caused during deformation. Specifically contemplated by this term are cold extrusion, cold heading, and wire and tube pulling deformation operations.

The unique coatings are provided by a phosphate coating solution. The phosphate coating solutions useful in the processes of the present invention are conventional in many respects other than the critical requirement that they contain an effective amount of the accelerating agent hydroxylamine. The presence of hydroxylamine imparts a unique character to the resulting phosphating coating, a character that makes them extremely useful in cold formation processes.

In the practice of the present invention, a ferrous-base metal article, such as a blank, slug or preform, is provided with a unique surface coating by contacting it with an aqueous acidic phosphate coating solution containing an effective amount of hydroxylamine. The coated article is then subjected to cold deformation.

The metal articles useful in the present invention are those which are ferrous-based, and which can be deformed at temperatures below their recrystallization temperatures. Preferred articles are steel articles with a carbon content less than about 1.0 percent, and preferably about 0.05 to about 0.6 percent by weight. However, as suggested above, the improved lubricant coatings provided in the cold deformation processes of the present invention allow the deformation of steels with higher alloy content, and greater hardness, than would otherwise be practicable.

The unique character of the coatings employed in the present invention result from the coating being deposited from a hydroxylamine-containing phosphate coating solution. The hydroxylamine can be added to the phosphate coating solution from any conventional source. Preferably, the hydroxylamine source is a shelf-stable hydroxylamine salt or complex; many of these are items of commerce and frequently exist in a hydrated form. More preferably, the hydroxylamine source is a coating solution concentrate formulated with hydroxylamine sulfate ("HAS"), a stable salt of hydroxylamine. HAS is also referred to as hydroxyl-ammonium sulfate. Hydroxylamine sulfate may be represented by the formulae $(NH_2OH)_2.H_2SO_4$ or $(NH_3OH)_2.SO_4$.

Any effective amount of hydroxylamine from any source may be employed in these phosphate coating solutions. By the term "effective amount", as used herein, is means sufficient hydroxylamine (regardless of the source) to accelerate the coating process. That is, when two substantially identical phosphate coating solutions (differing only in that one contains an amount of hydroxylamine and the other does not) are compared, the solution with hydroxylamine either (1) increases the coating weight deposited over a given period of time or (2) decreases the time it takes the solution to deposit a given coating weight.

Preferably, the phosphate coating solutions employed in the processes of the present invention contain a concentration of hydroxylamine of from about 0.01 percent to about 10 percent by weight; similar concentrations expressed as percent weight of hydroxylamine per volume of use solution may be interchangeably employed as the use solutions are primarily aqueous having a specific gravity of about 1. More preferably, the hydroxylamine is present in the phosphate coating solutions of the present process at a level of about 0.01 percent to about 3.0 percent, and still more preferably at a level of about 0.05 percent to about 1.0 percent by weight.

While not being bound by theory, it is thought that the presence of hydroxylamine in the coating solutions employed in the processes of the present invention contribute to the quality of lubricating or lubricant-retaining phosphate coatings by increasing the level of metal (especially zinc) which is present in the resulting coating. This increases the lubricating properties of the phosphate crystals themselves. More importantly, however, the increased level of zinc in the coating increases the ability of the first lubricant coating to be reactive with a second lubricating agent, particularly those which contain a fatty acid or fatty acid soap. For example, when a phosphate coating containing zinc is contacted with a second lubricant containing sodium stearate, the available zinc reacts with stearate moeities. The resulting zinc hydroxy stearate is an excellent lubricant, much better than sodium stearate. Thus, when more available zinc is brought down in the coating (per gram of coating weight), more zinc stearate will react when the coating is contacted with a sodium or potassium stearate (soap) containing lubricant. This increase in zinc hydroxy stearate significantly increases the ability of the surface to retain the second lubricant—the additional zinc hydroxy stearate also significantly increases overall lubricity.

The preferred phosphate coating solutions for use in the processes of the present invention contain zinc, manganese, or mixtures thereof. Of these, zinc (and the so-called high-zinc phosphating treatment solutions) are more highly preferred.

The phosphate coating solutions containing zinc preferably contain a level of about 0.25 percent to about 7.5 percent by weight, and more preferably about 0.75 percent to about 5.5 percent zinc by weight. Highly preferred are levels of zinc of about 1.0 percent to about 3.0 percent by weight.

Preferred coating solutions for use in the practice of the present invention contain phosphate at a level of about 0.5 percent to about 8.0 percent, more preferably about 1.0 percent to about 7.0 percent, and even more preferably about 2.0 percent to about 4.0 percent by weight. This can be expressed as weight of $[H_3PO_4]$ by weight solution.

The preferred phosphate coating solutions for use in the present invention also contain nitrate at a level of about 0.5 percent to about 10 percent by weight, and even more preferably about 1.0 percent to about 7.5 percent by weight. In a highly preferred embodiment, a phosphate coating solution having a nitrate level of about 3.0 percent to about 7.0 percent by weight, is employed in the cold deformation process of the present invention.

When both nitrate and phosphate are present in the phosphate coating solutions employed in the processes of the present invention, the quotient of the concentration of nitrate $[NO_3^-]$ over the concentration of the phosphate $[PO_4^{\equiv}]$, or $[NO_3^-]/[PO_4^{\equiv}]$ is about 0.3 to about 6.0, and more preferably about 0.5 to about 5.0; this quotient is about 0.9 to about 4.5 in a highly preferred embodiment.

One of the surprising features of the phosphate coating solutions employed in the practice of the present invention is the ability of these solutions to deposit coatings possessing a high concentration of zinc, even in the presence of ferrous (and ferric) ions. Thus, ferrous can be employed, either by deliberate addition, or by generation from the ferrous-base metal article being coated. If ferrous ions are present, it is preferred that they be present at a level of 0.05 percent to about 0.6 percent by weight. It will be appreciated that if no ferric iron is present, total iron can be used to determine this concentration; in the alternative, ferric and ferrous ion levels in solution must be determined.

The weight of the lubricating phosphate coating to be applied to the surface of the ferrous-base metal article to be employed in the fold deformation processes of the present invention will vary with the severity of the deformation process, the size of the article, and other factors which can be easily evaluated by the skilled artisan. This would include such other factors as whether a second lubricant will be applied, and if so, the type to be applied. Preferably, the coating weights to be applied are in the range of about 250 to about 6000 milligrams of coating per square foot of metal surface. Coating weights of about 350 to about 4500 milligrams per square foot are more preferred, with coating weights of about 500 to about 3500 milligrams per square foot being even more preferred.

In still another preferred embodiment the phosphate coating solutions employed in the processes of the present invention contain nickel. The nickel is preferably present at a level of about 0.005 percent to about 0.1 percent by weight, and even more preferably present at a level of about 0.01 percent to about 0.05 percent.

In a highly preferred embodiment, when the metal articles are contacted with the phosphate coating solutions employed in the cold deformation processes of the present invention, the solutions are maintained at a temperature of about 130° F. to about 205° F., and more preferably at a temperature of about 160° F. to about 190° F.; the solutions are preferably maintained at a pH of about 1.8 to about 2.5 while in this temperature range.

The coating solutions can be applied by conventional methods; they are preferably applied by flooding or immersion, and most preferably immersion. The time of exposure or contact times for immersion can be from about 0.5 minutes to about 30 minutes, and is preferably about 5 minutes to about 15.

After the surface of the ferrous-base metal article has been contacted with the phosphate coating solution, it is preferably subjected to a dilute, alkaline neutralizing rinse.

Following rinsing, the coated article which will eventually undergo cold deformation is preferably contacted with a second, conventional cold forming lubricant. This can be done immediately after coating (or rinsing), at press side immediately before formation, or during part or all of the cold deformation process (conjointly).

The second lubricant can be a soap, oil, drawing compound, or an emulsion of an oil and fatty acid, fatty acid salt, or soap. The second lubricant preferably contains a $C_8$–$C_8$ fatty acid or fatty acid salt or soap at a level of about 3 percent to about 15 percent by weight; more preferably, the second lubricant contains a soap selected from sodium stearate, potassium stearate, or mixtures thereof. As suggested before, these soaps are preferred because of their ability to react with the increased zinc levels found in the phosphate coatings employed in the present invention. The resulting zinc hydroxy stearate provides a highly preferred lubricant for cold deformation processes.

Drying after processing or between operations may be effected by conventional techniques such as forced air or flash drying.

In addition to the critical steps and preferred embodiments expressively recited above, a metal article subjected to the cold deformation process of the present invention may be additionally subjected to many conventional or commercial processes such articles ordinarily undergo.

For example, the metal article may undergo precoating cleaning and rinsing steps as needed to remove debris and to prepare the metal surface for the phosphate coating; the articles may also be picked prior to coating.

The metal articles subjected to the processes of the present invention may also undergo conventional post-coating processes, either before the optional application of a second lubricant, or before the cold deformation step, or both. For example, in a preferred embodiment the phosphate-coated metal article is rinsed shortly after coating with a dilute, alkaline, chromium-free neutralizing rinse. Such a rinse can employ weak alkalis and bases such as borox nitrite, triethanolamine, or mixtures thereof.

In a highly preferred embodiment, a metal article is (1) cleaned; (2) rinsed with hot water; (3) contacted with an aqueous acid phosphate coating solution containing an effective amount of hydroxylamine; (4) rinsed with cold water; (5) rinsed with a dilute, mildly alkaline solution; (6) contacted with an excess of a second, sodium stearate-based lubricant and (7) flash dried; even more preferably a conventional pickling step is added. The coated article may then be subjected to cold deformation either immediately, or after being stored until needed for the deformation step.

In order to further illustrate the benefits and advantages of the present invention, the following specific examples are provided. It will be understood that the examples are provided for illustrative purposes and are not intended to be limiting of the scope of the invention as herein disclosed and as set forth in the claims.

EXAMPLE 1

The following example demonstrates the preparation and use of phosphate coating solution for use in the practice of the present invention.

A fresh phosphating solution containing 4.05 percent zinc, 5.00 percent phosphate ($PO_4^{=}$), 5.55 percent nitrate ($NO_3^-$), 0.01 percent nickel and a total acid of 60 points (5.0 ml sample titrated with 0.1N NaOH to phenolphthalein endpoint, total acid points being equal to milliliter of 0.1N NaOH used to endpoint) was heated to 180° F. Once at 180° F., 5.0 gm/l (0.5 percent hydroxylamine sulfate (H.A.S.) was added. After allowing 5 minutes for equilibrium to be reached, 0.007 percent sodium nitrate ($NaNO_2$) was added. After another 5 minutes, 4"×6"×14 gauge, cold rolled steel, picked panels, two (2) at a time, were coated for five (5) minute immersions every ten (10) minutes (approximate loading rate of 3.8 $ft^2$ surface/hr. gal). Zinc phosphate coating weight analysis revealed that not only was there a two-fold increase in coating weight, but also that the coating weights do not increase as rapidly as seen using the same bath and conditions but without H.A.S. Crystal morphology/composition remained the same when using H.A.S., with P-ratios [ratio of phosphopyllite: (phosphopyllite+hopeite) as measured by x-ray crystalogrophy)] being about 0.105 versus 0.165 for the process without H.A.S. This indicates an acceptable level of zinc in the phosphate coating. [reactivity with reactive soap lubricants, however, was lower when H.A.S. was incorporated into the phosphating solution when the second lubricant was applied approximately 30 days after coating].

Articles treated with the solutions described above can then be subjected to conventional weakly alkaline rinsing. A reasonable time after rinsing (within about 5 hours) a second sodium stearate-containing lubricant is applied. After application of the second lubricant, the article is subjected to flash drying, and the excess soap is allowed to remain. The article is then subjected to a conventional cold deformation process such as extrusion with excellent results. Such articles are more efficiently subjected to conventional cold deformation processes than articles coated by conventional phosphate-coating solutions.

EXAMPLE 2

A phosphate coating solution concentrate is prepared for use in the process of the present invention as follows:

| Concentrate A | |
|---|---|
| INGREDIENT | PARTS BY WEIGHT |
| Water | 360.5 |
| Zinc Oxide (80.3% Zn) | 159.0 |
| Nitric Acid (42° Be' 67% $HNO_3$) | 255.5 |
| Phosphoric Acid (75% $H_3PO_4$) | 216.7 |
| Hydroxylamine Sulfate | 6.0 |
| Nickel Nitrate (13.9% Ni; 29.37.$NO_3$) | 2.3 |
| | 1000.0 |

This concentrate is then diluted to prepare a use solution; this dilution is preferably done by using a ratio of 175 pounds of concentrate for every 100 gallons (U.S.) of final use solution, or 210 grams per liter of use of solution.

During use, the use solution prepared from Concentrate A can be replenished or revitalized with the following concentrate.

| Concentrate B | |
|---|---|
| INGREDIENT | PARTS BY WEIGHT |
| Water | 302.2 |
| Zinc Oxide (80.3% Zn) | 132.3 |
| Nitric Acid (42° Be' 67% $HNO_3$) | 143.1 |
| Phosphoric Acid (75% $H_3PO_4$) | 400.8 |
| Nickel Nitrate (13.9% Ni; 29.3% $NO_3$) | 1.6 |
| Hydroxylamine Sulfate | 20.0 |
| | 1000.0 |

This replenisher can be employed when the ratio of total acid:free acid in the use solution rises above the desired level; Concentrate A can be used to revitalize the use solution if the ratio falls below the desired value.

What is claimed is:

1. A process for the cold deformation of a ferrous-base metal article comprising the steps of:

(a) contacting the surface of the article with a first lubricant which comprises an aqueous acidic zinc, manganese or zinc/manganese lubricating phosphate coating solution additionally containing from 0.5 to 10.0 wt. % nitrate ion and from 0.01 to 10 wt. % hydroxylamine;

(b) thereafter contacting the surface with a second lubricant which contains a $C_8$ to $C_{18}$ fatty acid, fatty acid salt, fatty acid soap, or mixtures thereof; and (c) thereafter subjecting the coated article to cold deformation.

2. A process according to claim 1 wherein the second lubricant is selected from the group consisting of sodium stearate, potassium stearate, or mixture thereof.

3. A process according to claim 1 wherein the phosphate coating solution is a zinc phosphate coating solution.

4. A process according to claim 1 wherein the phosphate coating solution is a zinc phosphate coating solution.

5. A process according to claim 3 wherein the zinc is present in the phosphate coating solution at a level of about 0.25 percent to about 7.5 percent by weight.

6. A process according to claim 5 wherein the zinc is present in the phosphate coating solution at a level of about 0.75 percent to about 5.5 percent by weight.

7. A process according to claim 6 wherein the zinc is present in the phosphate coating solution at a level of about 1.0 percent to about 3.0 percent by weight.

8. A process according to claim 1 wherein the phosphate is present in the phosphate coating solution at a level of about 0.5 percent to about 8.0 percent by weight.

9. A process according to claim 8 wherein the phosphate is present in the phosphate coating solution at a level of about 1.0 percent to about 7.0 percent by weight.

10. A process according to claim 9 wherein the phosphate is present in the phosphate coating solution at a level of about 1.5 percent to about 4.0 percent by weight.

11. A process according to claim 1 wherein the zinc phosphate coating solution contains nitrate ions at a level of about 1.0 percent to about 7.5 percent by weight.

12. A process according to claim 11 wherein the zinc phosphate coating solution contains nitrate ions at a level of about 3.0 to about 7.0 by weight.

13. A process according to claim 1 wherein the quotient of the concentration of nitrate over the concentration of phosphate is about 0.3 to about 6.0.

14. A process according to claim 13 wherein the quotient is about 0.5 to about 5.0.

15. A process according to claim 14 wherein the quotient is about 0.9 to about 4.5.

16. A process according to claim 1 wherein ferrous iron is present in the phosphate coating solution at a level of about 0.05 percent to about 0.6 percent by weight.

17. A process according to claim 1 wherein the lubricating phosphate is deposited upon the surface of the metal article at a weight of about 350 mg to about 4500 mg of metal phosphate per square foot of metal surface.

18. A process according to claim 17 wherein the lubricating phosphate is deposited upon the surface of the metal article at a weight of about 500 mg to 3500 mg of metal phosphate per square foot of metal surface.

19. A process according to claim 1 wherein the phosphate coating solution contains nickel at a level of about 0.005 percent to about 0.1 percent by weight.

20. A process according to claim 1 wherein the lubricating phosphate coating solution is controlled at a temperature of about 130° F. when contacting the metal article.

21. A process according to claim 20 wherein the lubricating phosphate coating solution is controlled at a temperature of about 160° F. to about 190° F. when contacting the metal article.

22. A process according to claim 20 wherein the lubricating phosphate coating solution is controlled at a pH of about 1.8 to about 2.5.

23. A process according to claim 1 wherein both ferrous and ferric ions are present in the phosphate coating solution.

24. A process according to claim 1 wherein the hydroxylamine is present in the phosphate coating solution at a level of from about 0.01 percent to about 3.0 percent by weight.

25. A process according to claim 24 wherein the hydroxylamine is present in the phosphate coating solution at a level of from about 0.05 percent to about 1.0 percent by weight.

* * * * *

UNITED STATES PATENT AND TRADEMARK OFFICE

CERTIFICATE OF CORRECTION

PATENT NO. : 5,234,509

DATED : August 10, 1993

INVENTOR(S) : Thomas W. Tull

It is certified that error appears in the above-indentified patent and that said Letters Patent is hereby corrected as shown below:

On the Title Page:

Under Related U.S. Application Data, "Aug. 8, 1988" should be --Aug. 9, 1988--.

Under U.S. Patent Documents, reference 2,298,280, "Clifford" should be --Clifford et al--.

Under U.S. Patent Documents, reference 2,743,204, "Russel" should be --Russell--.

Under U.S. Patent Documents, reference 4,517,029, "Sanoda" should be --Sonoda et al--.

Under U.S. Patent Documents, insert the following:

--3,923,554 12/1975 Ziemba--
--4,292,096 9/1981 Murakami et al--.

Column 1, line 6, "Aug. 8, 1988" should be --Aug. 9, 1988--.

Column 2, line 27, "prelubricantion" should be --prelubrication--.

Column 4, line 6, delete --is--.

Column 4, line 42, "moeities" should be --moieties--.

Column 5, line 35, "fold" should be --cold--.

Column 6, line 15, "$C_8$-$C_8$" should be --$C_8$-$C_{18}$--.

Column 6, line 30, "expressively" should be --expressly--.

UNITED STATES PATENT AND TRADEMARK OFFICE

CERTIFICATE OF CORRECTION

PATENT NO. : 5,234,509

DATED : August 10, 1993

INVENTOR(S) : Thomas W. Tull

It is certified that error appears in the above-indentified patent and that said Letters Patent is hereby corrected as shown below:

Column 6, line 39, "picked" should be --pickled--.

Column 7, line 12, after "percent" insert --)--.

Column 7, line 16, "picked" should be --pickled--.

Column 7, line 22, "increase" should be --decrease--.

Column 9, line 3, after "7.0" insert --percent--.

Signed and Sealed this

Tenth Day of May, 1994

Bruce Lehman

*Attest:*

BRUCE LEHMAN

*Attesting Officer*

*Commissioner of Patents and Trademarks*